US007497721B2

(12) United States Patent
Lauermann et al.

(10) Patent No.: US 7,497,721 B2
(45) Date of Patent: Mar. 3, 2009

(54) TOOL EXTRACTABLE CONTACTS FOR ELECTRICAL CONNECTORS

(75) Inventors: Mark E. Lauermann, Harrisburg, PA (US); Donald A. Diemer, Oak Ridge, NC (US); Donald M. Baughn, Burlington, NC (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/839,685

(22) Filed: Aug. 16, 2007

(65) Prior Publication Data

US 2008/0070446 A1 Mar. 20, 2008

Related U.S. Application Data

(63) Continuation-in-part of application No. 11/532,075, filed on Sep. 14, 2006.

(51) Int. Cl.
*H01R 11/20* (2006.01)

(52) U.S. Cl. ..... 439/441; 439/744; 439/626; 439/884; 439/595

(58) Field of Classification Search ..... 439/744, 439/441, 626, 747, 888, 877–878, 884, 595
See application file for complete search history.

(56) References Cited

U.S. PATENT DOCUMENTS

| | | | | |
|---|---|---|---|---|
| 2,762,026 | A | 9/1956 | Knohl | |
| 3,566,342 | A * | 2/1971 | Schmitt et al. | 439/747 |
| 4,030,803 | A | 6/1977 | Langenbach | |
| 5,207,603 | A * | 5/1993 | Peloza | 439/884 |

FOREIGN PATENT DOCUMENTS

| | | | |
|---|---|---|---|
| EP | 0 676 827 | A | 10/1995 |
| EP | 0 760 540 | A | 3/1997 |

* cited by examiner

*Primary Examiner*—Truc T Nguyen

(57) ABSTRACT

A connector system for use with electronics is provided. This system includes at least one electrical contact that further includes a wire retaining portion and an elongated body portion. The body portion of the contact further includes at least one outwardly biased latch that is adapted to engage both a contact cavity formed within a connector housing component and an extraction tool designed to remove the contact from the housing component, if necessary. The latch is formed from the same material as the body portion of the contact and further includes an internal biasing member and an external engagement member formed at the end of the biasing member for frictionally engaging the housing component and the extraction tool.

20 Claims, 5 Drawing Sheets

TOOL EXTRACTABLE CONTACTS FOR ELECTRICAL CONNECTORS

CROSS-REFERENCE TO RELATED APPLICATIONS

This patent application is a continuation-in-part of U.S. patent application Ser. No. 11/532,075 filed on Sep. 14, 2006 and entitled "ELECTRICAL CONTACT WITH WIRE TRAP", the disclosure of which is incorporated by reference as if fully rewritten herein.

BACKGROUND OF THE INVENTION

The described invention relates in general to connector systems for use with electronic equipment, and more specifically to connector systems that utilize pin and socket type contacts (i.e., terminals) such as those typically found in MATE-N-LOK systems or comparable systems, wherein the pin and socket contacts are modified to be more easily extractable from connector housings using an extraction tool.

"Molex connector" is a common term used for a two-piece "pin and socket" type interconnection that is frequently used for disk drive connectors and other devices. Pioneered by Molex Products Company, the two-piece design became an early standard in the electronics industry. First used in home appliances, other industries soon began to incorporate these connectors into products ranging from automobiles to vending machines to mini-computers. These connectors include cylindrical spring-metal pins that fit into cylindrical spring-metal sockets. The pins and sockets are usually configured in a rectangular matrix, which is held in a nylon shell or other type of shell, and an individual connector typically includes 2, 3, 4, 5, 6, 9, 12, or 15 pin and socket pairs, each representing a different electronic circuit. Pins and sockets can be arranged in various possible combinations within a single connector and the housing is typically separated into male and female portions. AMP (now a division of Tyco Electronics) developed the MATE-N-LOK 0.084 pin connector, which was initially used on disk drives. This interconnection configuration is now the established standard for disk drive power connectors.

Despite its widespread adoption, the MATE-N-LOK connector system has certain shortcomings. For example, when in use, the pin and socket contacts may experience inconsistent retention within the housing portions of the connector system. Inconsistent retention within the housing may lead to partial or total failure of the connector and consequently to diminished performance or even failure of the device into which the connector is incorporated. Thus, there is an ongoing need for pins and sockets that provide more consistent and reliable retention within the housing of the connector. If one or more of the contacts has been mis-wired, the contact is usually removed from the housing portion for re-wiring. A specially designed tool may be used to extract pins and/or sockets from the housing portion. Therefore, there is an ongoing need for pins or sockets that provide consistent and reliable retention within the housing of the connector and that are easily extractable from the housing, when necessary.

SUMMARY OF THE INVENTION

The following provides a summary of exemplary embodiments of the present invention. This summary is not an extensive overview and is not intended to identify key or critical aspects or elements of the present invention or to delineate its scope.

In accordance with one aspect of the present invention, a connector system for use with electronics is provided. This system includes a connector assembly, wherein the connector assembly further includes at least one housing component and wherein the housing component further includes at least one contact cavity; and at least one electrical contact, which may be a pin contact or a socket contact, and which further includes a wire retaining portion and a mating portion formed integrally with an elongated body portion. The body portion of the contact further includes at least one and typically two outwardly biased latches and each of these latches is adapted to effectively engage both the interior of the contact cavity and an extraction tool, if necessary. Each of the latches is typically formed from the same material as the body portion of the contact and is integral therewith and further includes an internal biasing member and an angled external engagement member formed at the end of the biasing member for frictionally engaging both the contact cavity and the extraction tool. In this embodiment, a tool for extracting the contact or contacts is included in the claimed system.

In accordance with another aspect of the present invention, an electrical contact for use with electronics is provided. This connector contact, which may be a pin contact or a socket contact, includes a wire retaining portion and a mating portion formed integrally with a body portion. The body portion of the contact further includes at least one and typically two outwardly biased latches and each of these latches is adapted to effectively engage both the interior of a connector housing, i.e., a contact cavity, and an extraction tool, if necessary. Each of the latches is formed from the same material as the body portion of the contact and is integral therewith and further includes an internal biasing member and an external engagement member formed at the end of the biasing member for frictionally engaging both the housing and the extraction tool. The internal biasing member includes a downwardly angled portion and an upwardly angled portion and the external engagement member includes a first angled portion and a second angled portion.

In yet another aspect of this invention, a method for extracting an electrical contact from the housing portion of a connector assembly is provided. This method includes the steps of: inserting at least one specially modified contact, which may be either a pin contact or socket contact, into a housing component; and extracting the contact from the housing component with an extraction tool specifically designed to work with the contact. The contact typically includes a wire retaining portion and a mating portion formed integrally with a body portion. The body portion of the pin connector further includes at least one and typically two outwardly biased latches and each of these latches is adapted to effectively engage the extraction tool when the extraction tool is inserted into the housing. Each of the latches is typically formed from the same material as the body portion of the connector pin and is integral therewith and further includes an internal biasing member and an external engagement member formed at the end of the biasing member for frictionally engaging the extraction tool. The extraction tool simultaneously engages each of the latches and the application of sufficient force to the tool will extract the pin.

Additional features and aspects of the present invention will become apparent to those of ordinary skill in the art upon reading and understanding the following detailed description of the exemplary embodiments. As will be appreciated by the skilled artisan, further embodiments of the invention are possible without departing from the scope and spirit of the invention. Accordingly, the drawings and associated descriptions are to be regarded as illustrative and not restrictive in nature.

BRIEF DESCRIPTION OF THE DRAWINGS

The accompanying drawings, which are incorporated into and form a part of the specification, schematically illustrate one or more exemplary embodiments of the invention and, together with the general description given above and detailed description given below, serve to explain the principles of the invention, and wherein.

DETAILED DESCRIPTION OF THE INVENTION

Figure 1:
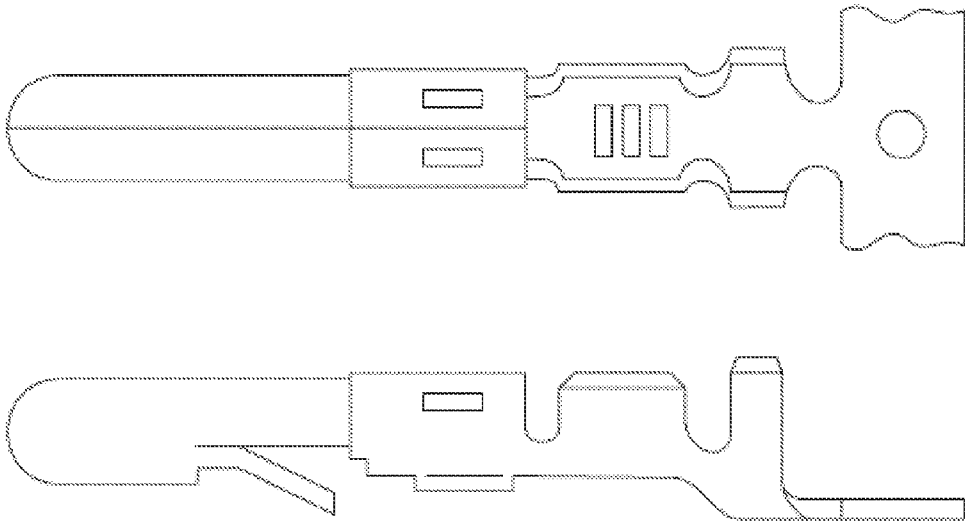
FIG. 1 (Prior Art)
FIG. 1 includes both a top view and a side view of a prior art pin contact.
Figure 2:
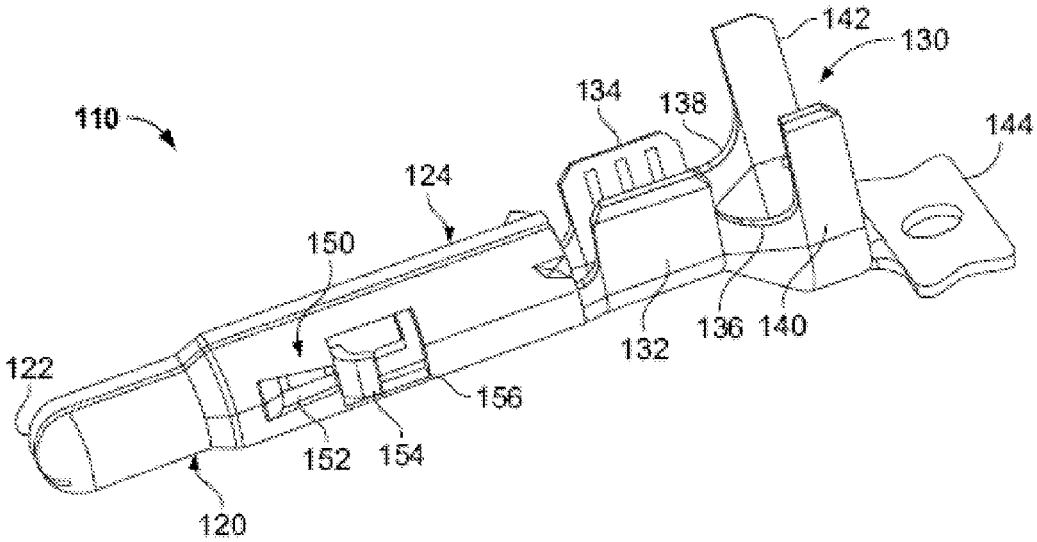
FIG. 2 is a perspective side view of an exemplary embodiment of a pin contact in accordance with the present invention showing the placement of one of the latch features on the body portion of the pin contact.
Figure 3:
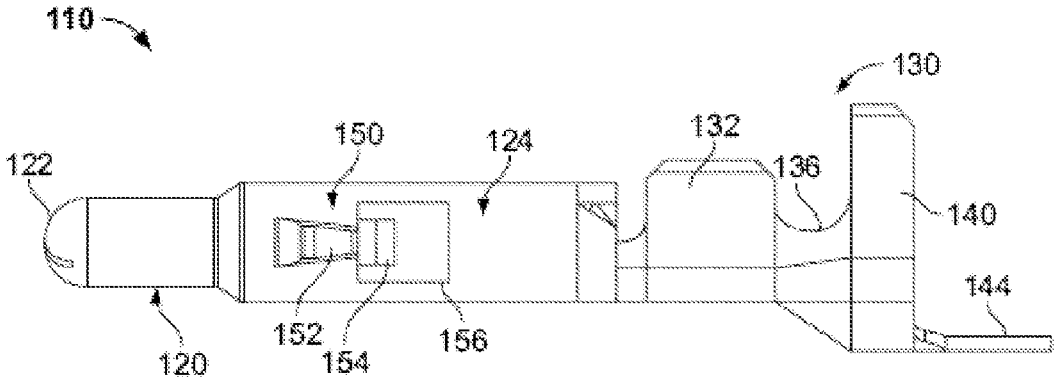
FIG. 3 is a side view of the pin contact of FIG. 2.
Figure 4:
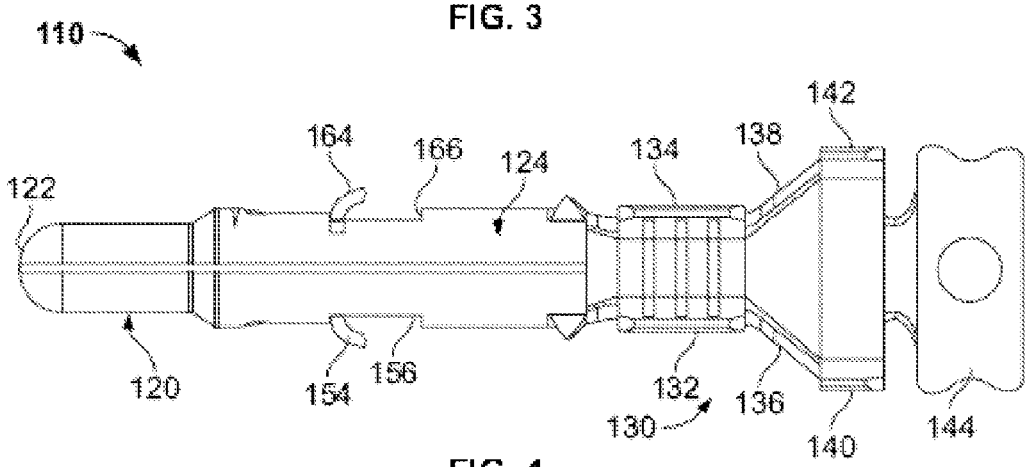
FIG. 4 is a top view of the pin contact of FIG. 2.
Figure 5:
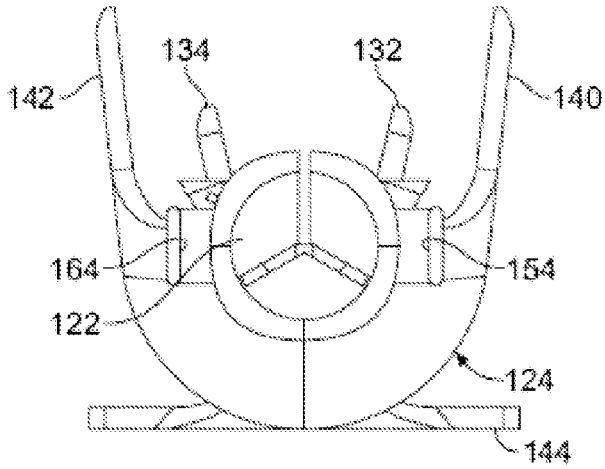
FIG. 5 is a front view of the pin contact of FIG. 2.

Exemplary embodiments of the present invention are now described with reference to the Figures. Reference numerals are used throughout the detailed description to refer to the various elements and structures. In other instances, well-known structures and devices are shown in block diagram form for purposes of simplifying the description. Although the following detailed description contains many specifics for the purposes of illustration, anyone of ordinary skill in the art will appreciate that many variations and alterations to the following details are within the scope of the invention. Accordingly, the following embodiments of the invention are set forth without any loss of generality to, and without imposing limitations upon, the claimed invention.

The present invention relates to a connector system that includes connector housing components and pin and socket contacts that are mounted within the housing components. A first general embodiment of this invention provides a connector system that includes both pin contacts and socket contacts that each include at least one engaging/retaining latch; a second general embodiment of this invention provides an individual electrical contact that includes at least one engaging/retaining latch; and a third general embodiment of this invention provides a method for effectively extracting an electrical contact from a housing portion of a connector assembly. With reference now to the Figures, one or more specific embodiments of this invention shall be described in greater detail.

With reference now to the Figures, FIG. 1 provides several views of a prior art pin contact that does not include the features of this invention and FIGS. 2-7 provide various views illustrative views of an exemplary MATE-N-LOK pin contact in accordance with the present invention. As shown in FIGS. 2-7, pin contact 110 includes socket mating portion 120, a hollow elongated body 124, and wire retaining portion 130. Socket mating portion 120 includes a rounded tip 122, which is adapted to be inserted into a corresponding MATE-N-LOK socket as part of a standard MATE-N-LOK system or similar pin-and-socket mating system. Wire retaining portion 130 is adapted to receive a length of partially stripped wire and includes a wire barrel, a locator slot, and an insulation barrel. The wire barrel includes first and second tabs 132 and 134, the locator slot includes first and second notches 136 and 138, and the insulation barrel includes first and second tabs 140 and 142. In use, tabs 132 and 134 are crimped around the stripped portion of the wire and tabs 140 and 142 are crimped around the insulated portion of the same wire. Pin contact 110 is typically manufactured on a carrier strip with other pin contacts. A portion 144 of this carrier strip is shown the figures.

Figure 6:
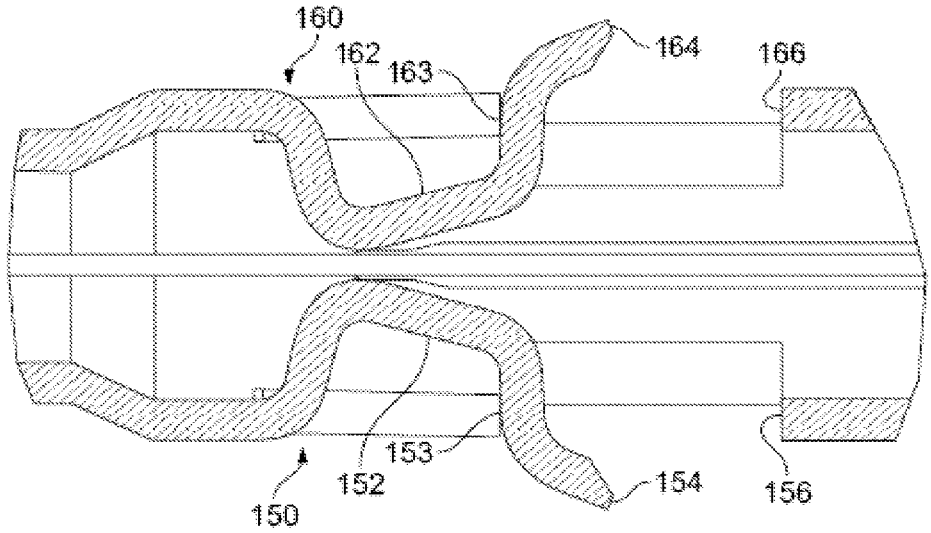
FIG. 6 is a cutaway top view of the latch feature of the pin contact of FIG. 2.
Figure 7:
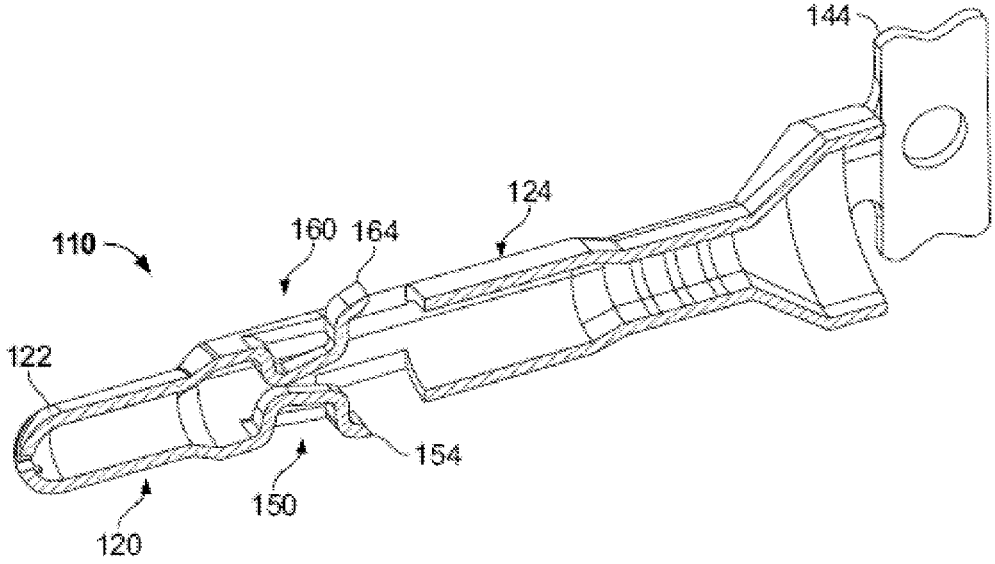
FIG. 7 is a perspective cutaway top view of the pin contact of FIG. 2.

As best shown in FIGS. 6-7, first and second outwardly biased engaging/retaining latches 150 and 160 are formed on either side of body 124 near tip 122. Latch 150 includes an internally positioned tapered (see FIG. 3) biasing member 152 and an angled engagement member 154 that protrudes from body 124 through aperture 156. Likewise, latch 160 includes an internally positioned tapered biasing member 162 and a multi-angled engagement member 164 that protrudes from body 124 through aperture 166. Tapering biasing members 152 and 162 generally increases the resilience thereof. In the exemplary embodiment, both latches 150 and 160 are formed integrally with and from the same material as body 124, which is typically an electrically conductive metal. Pin contact 110 is usually stamped from a piece of metal and rolled into its final shape. Biasing members 152 and 162, which are generally radially biased, provide a spring-loaded effect to engagement members 154 and 164 respectively, thereby enhancing the ability of engagement members 154 and 164 to engage the interior of a connector housing, i.e., a contact cavity (see below), and an extraction tool, when necessary. Biasing members 152 and 162 are typically formed in body 124 prior to rolling and portions of members 152 and 162 may be sheared to create engagement members 154 and 164.

Figure 8:
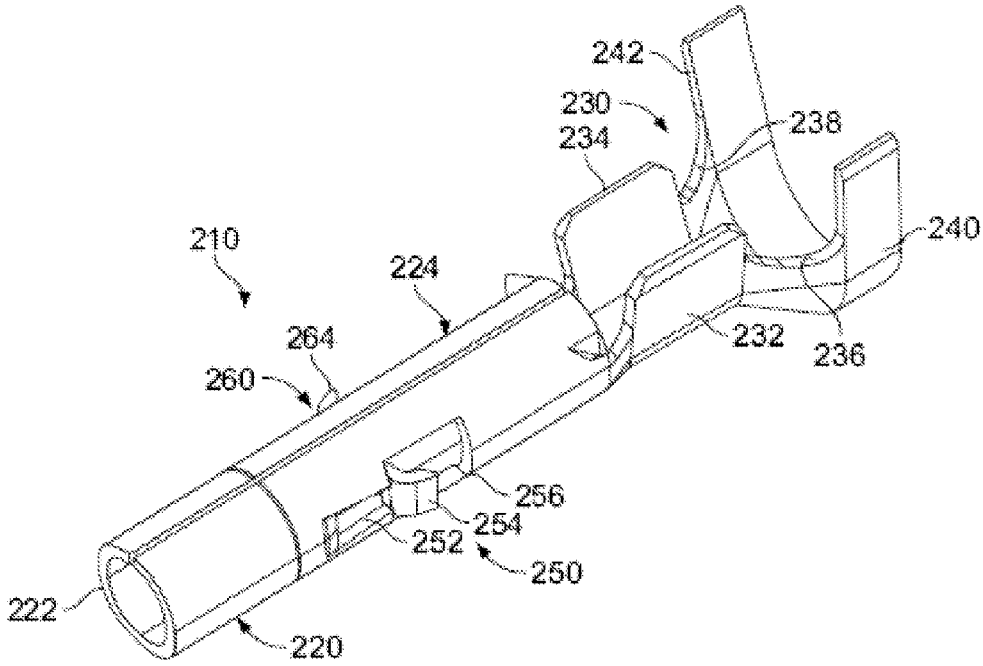
FIG. 8 is a perspective view of an exemplary embodiment of a socket contact in accordance with the present invention showing the placement of the latch features on the body portion of the socket contact.
Figure 11:
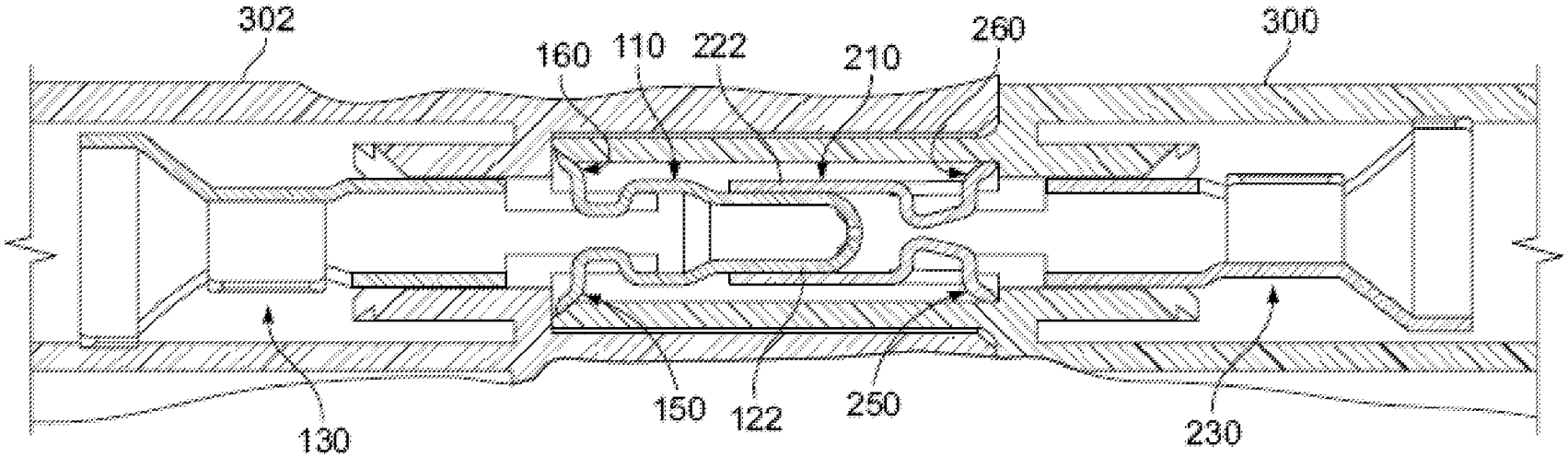
FIG. 11 is a cross-sectional side view of an exemplary embodiment of the pin contact of the present invention inserted into an exemplary embodiment of the socket contact of the present invention, wherein both the pin and the socket have been inserted into either a plug housing or a cap housing.

As shown in FIG. 8, latches 250 and 260 may also be included on socket contact 210. The exemplary embodiment of socket contact 210 shown in FIG. 8 includes the same basic structural features of pin contact 110; however, tip 222 of mating portion 220 includes a socket (rather than a rounded tip) which is adapted to receive a pin contact 110 for establishing an electrical connection therewith (see FIG. 11). Socket contact 210 includes in mating portion 220, a hollow elongated body 224, and wire retaining portion 230. Wire retaining portion 230 is adapted to receive a length of stripped wire and includes a wire barrel, a locator slot, and an insulation barrel. The wire barrel includes first and second tabs 232 and 234, the locator slot includes first and second notches 236 and 238, and the insulation barrel includes first and second tabs 240 and 242. In use, tabs 232 and 234 are crimped around the stripped portion of a wire and tabs 240 and 242 are crimped around the insulated portion of the same wire. First and second outwardly biased engaging/retaining latches 250 and 260 are formed on either side of body 224 near tip 222. Latch 250 includes an internally positioned tapered biasing member 252 and an angled engagement member 254 that protrudes from body 224 through aperture 256. Likewise, latch 260 includes an internally positioned tapered biasing member and a multi-angled engagement member 264 that protrudes from body 224. In the exemplary embodiment, both latches 250 and 260 are formed integrally with and from the same material as body 224, which is typically an electrically conductive metal. Socket contact 210 is typically manufactured using the same basic method described above for pin contact 110.

Figure 9:
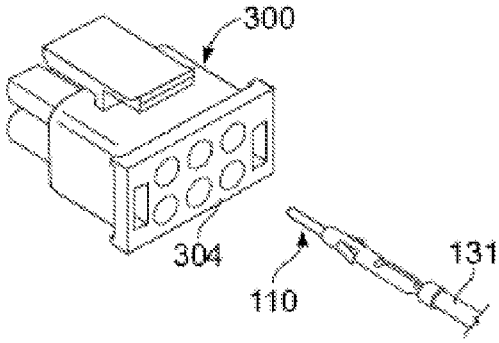
FIG. 9 is a perspective view of the pin contact of the present invention prior to insertion into one of the contact cavities within the plug housing component of an exemplary connector system.
Figure 10:
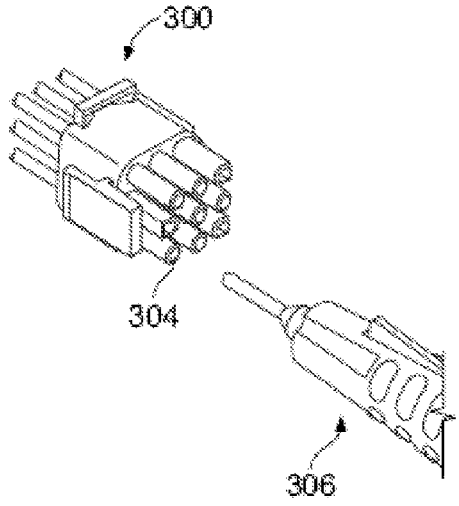
FIG. 10 is a perspective view of an extraction tool prior to extracting a pin contact from a contact cavity formed in a plug housing.

As previously indicated, pin contact 110 and socket contact 210 are intended for use with connector systems included in electronic devices. Such connector systems typically include a connector assembly that further includes multiple housing components. In some connector systems these housing components are referred to as a plug housing 300 and a cap housing 302 (see FIGS. 9-11). Each housing component typically includes at least one contact cavity 304 formed therein for receiving either a pin contact 110 or a socket contact 210. When a pin or socket contact is inserted into a contact cavity (from the rear side of the housing portion), the described latches engage the inner surface of the contact cavity and securely retain the contact therein. The described engagement members are typically longer than the lance structure included on prior art pins (see FIG. 1) and generally provide more resiliency for engaging the contact cavity. As shown in FIG. 6, sections 153 and 163 of latch 150 and latch 160 respectively back up to or are seated against a portion of body 124 that is not part of either latch. This configuration provides additional structural support to latches 150 and 160, thereby preventing the latches from folding back upon themselves and reducing the likelihood that a contact will be inadvertently pulled from the housing during use. The same is true for latches 250 and 260 on socket pin 210.

Also, as previously described, the latches (150 and 160 or 250 and 260) facilitate removal of pin contact 110 or socket contact 210 from a contact cavity in the event that a pin has been mis-wired and/or inserted into the wrong contact cavity. An extraction tool 306 (see FIG. 10) is typically used to remove the contacts from the housing component in which they are mounted. Extraction tool 306 is inserted into the contact cavity (from the front side of the housing) such that the cylindrical sleeve portion of the extraction tool extends over the tip of the contact and engages the latches. As the cylindrical sleeve moves over the latches, the forward motion of the sleeve depresses the latches radially inward, thereby forcing the latches to recede into the body, thereby releasing the contact from the contact cavity. In the exemplary embodiments described herein, a "4-bend" design (see FIG. 6) used for each latch (150, 160, 250, 260) allows for more radial deflection (and less axial deflection) of the engagement members (154, 164, 254, 264) respectively. This 4-bend configuration creates four distinct sections or regions on each latch, and as will be appreciated by the skilled artisan, reduces tolerances involved in proper insertion and retention of the contacts compared with less complex designs, i.e., 2-bend designs. Additionally, the relatively shallow angle of the engagement members generally provides more surface area for extraction tool 306 to engage. When the sleeve reaches the bottom of the housing component, the operator releases a lever on extraction tool that retains a spring-loaded solid plunger inside of the sleeve. Further forward pushing on extraction tool pushes the solid plunger against the tip of the contact while the latches are still depressed, thereby pushing the contact back out of the housing portion in which it had been inserted. In other embodiments of this invention, a somewhat simplified version of the latch structure is utilized, wherein one of the "bends" in each latch has been removed.

While the present invention has been illustrated by the description of exemplary embodiments thereof, and while the embodiments have been described in certain detail, it is not the intention of the Applicant to restrict or in any way limit the scope of the appended claims to such detail. Additional advantages and modifications will readily appear to those skilled in the art. Therefore, the invention in its broader aspects is not limited to any of the specific details, representative devices and methods, and/or illustrative examples shown and described. Accordingly, departures may be made from such details without departing from the spirit or scope of the applicant's general inventive concept.

What is claimed:

1. A connector system for use with electronics, comprising:

(a) a connector assembly, wherein the connector assembly further includes at least one housing component, and wherein the housing component further includes at least one contact cavity formed therein;

(b) at least one electrical contact inserted into the contact cavity, wherein the contact further includes:

(i) a wire retaining portion; and (ii) an elongated body portion formed integrally with the wire retaining portion, wherein the body portion further includes at least one outwardly biased latch, wherein the latch is formed from the same material as the body portion of the contact and further includes:

a) a first section, wherein the first section is angled into the body of the electrical contact;

b) a second section formed integrally with the first section, wherein the second section resides within the body of the contact and angles rearwardly away from the first section;

c) a third section formed integrally with the second section, wherein the third section angles upwardly away from the second section and exits the body of the electrical contact; and d) a fourth section formed integrally with the third section, wherein the fourth section angles rearwardly away from the third section and further includes an engagement member for engaging the contact cavity; and (c) a tool for extracting the at least one electrical contact from the housing component, wherein the extracting tool engages the engagement member formed at the end of the biasing member when the extraction tool is inserted into the contact cavity and pushes the electrical contact out of the housing component.

2. The system of claim 1, further comprising a length of insulated conductive wire attached to the at least one electrical contact, wherein a portion of the insulation has been stripped to expose a portion of the wire.

3. The system of claim 2, wherein the wire retaining portion of the electrical contact further includes a crimpable wire barrel for securing the exposed portion of the wire to the contact, a locator slot, and a crimpable insulation barrel for securing the insulated portion of the wire to the contact.

4. The system of claim 1, wherein the housing component is either a plug housing or a cap housing.

5. The system of claim 1, wherein the electrical contact is either a pin contact or a socket contact.

6. The system of claim 1, wherein the body portion of each electrical contact terminates in a mating portion that is either a pin or a socket.

7. The system of claim 1, wherein the electrical contact is stamped from a single piece of material and wherein the material is electrically conductive metal.

8. The system of claim 1, wherein the electrical contact is fabricated on a carrier strip.

9. An electrical contact for use with electronic devices, comprising:

(a) a wire retaining portion; and (b) a body portion formed integrally with the wire retaining portion, wherein the body portion further includes at least one outwardly biased retention latch, wherein the latch is formed from the same material as the body portion of the contact as is integral therewith and further includes:

(i) a first section, wherein the first section is angled into the body of the electrical contact;

(ii) a second section formed integrally with the first section, wherein the second section resides within the body of the contact and angles rearwardly away from the first section;

(iii) a third section formed integrally with the second section, wherein the third section angles upwardly away from the second section and exits the body of the electrical contact; and (iv) a fourth section formed integrally with the third section, wherein the fourth section angles rearwardly away from the third section and further includes an engagement member formed at the end thereof.

10. The electrical contact of claim 9, wherein the wire retaining portion of the contact further includes a crimpable wire barrel, a locator slot, and a crimpable insulation barrel.

11. The electrical contact of claim 9, wherein the contact is either a pin contact or a socket contact.

12. The electrical contact of claim 9, wherein the body portion of the contact terminates in a mating portion that is either a pin or a socket.

13. The electrical contact of claim 9, wherein the contact is stamped from a single piece of material and wherein the material is electrically conductive metal.

14. The electrical contact of claim 9, wherein the contact is fabricated on a carrier strip.

15. The electrical contact of claim 9, wherein the contact is adapted to be mounted within a connector assembly housing component.

16. A method for extracting an electrical contact from a connector assembly, comprising:

(a) providing a connector assembly, wherein the connector assembly further includes at least one housing component, wherein the housing component further includes at least one contact cavity formed therein, wherein an electrical contact has been inserted into the contact cavity, and wherein the contact further includes:

(i) a wire retaining portion; and ii) an elongated body portion formed integrally with the wire retaining portion, wherein the body portion further includes at least one outwardly biased latch, wherein the latch is formed from the same material as the body portion of the contact and further includes:

a) a first section, wherein the first section is angled into the body of the electrical contact;

b) a second section formed integrally with the first section, wherein the second section resides within the body of the contact and angles rearwardly away from the first section;

c) a third section formed integrally with the second section, wherein the third section angles upwardly away from the second section and exits the body of the electrical contact; and d) a fourth section formed integrally with the third section, wherein the fourth section further includes an engagement member for engaging the contact cavity; and (b) providing a tool for extracting the at least one electrical contact from the housing component, wherein the extracting tool engages the engagement member formed at the end of the biasing member when the extraction tool is inserted into the contact cavity and pushes the electrical contact out of the housing component.

17. The method of claim 16, wherein the housing component is either a plug housing or a cap housing.

18. The method of claim 16, wherein the wire retaining portion of the contact further includes a crimpable wire barrel, a locator slot, and a crimpable insulation barrel.

19. The method of claim 16, wherein the contact is either a pin contact or a socket contact.

20. The method of claim 16, wherein the contact is stamped from a single piece of material and wherein the material is electrically conductive metal.

* * * * *